US007413003B2

(12) United States Patent
Oh et al.

(10) Patent No.: US 7,413,003 B2
(45) Date of Patent: Aug. 19, 2008

(54) PLATE FOR HEAT EXCHANGER

(75) Inventors: Kwangheon Oh, Daejeon-si (KR); Sungje Lee, Daejeon-si (KR); Hongyoung Lim, Daejeon-si (KR)

(73) Assignee: Halla Climate Control Corporation, Daejeon-Si (KR)

( * ) Notice: Subject to any disclaimer, the term of this patent is extended or adjusted under 35 U.S.C. 154(b) by 48 days.

(21) Appl. No.: 11/522,143

(22) Filed: Sep. 15, 2006

(65) Prior Publication Data

US 2008/0066893 A1 Mar. 20, 2008

(51) Int. Cl.
*F28D 9/00* (2006.01)

(52) U.S. Cl. ..... 165/153; 165/152; 165/174

(58) Field of Classification Search ..... 165/153, 165/174, 176

See application file for complete search history.

(56) References Cited

U.S. PATENT DOCUMENTS

| | | | | |
|---|---|---|---|---|
| 4,800,954 | A * | 1/1989 | Noguchi et al. | 165/153 |
| 5,630,473 | A | 5/1997 | Nishishita | |
| 6,173,764 | B1 | 1/2001 | Inoue | |
| 6,863,120 | B2 * | 3/2005 | Hwang et al. | 165/153 |
| 2001/0018969 | A1 * | 9/2001 | Shin et al. | 165/153 |
| 2003/0070797 | A1 | 4/2003 | Narahara et al. | |
| 2003/0145981 | A1 * | 8/2003 | Hark et al. | 165/153 |

FOREIGN PATENT DOCUMENTS

| | | |
|---|---|---|
| DE | 198 07 080 A1 | 8/1998 |
| EP | 0 650 024 A1 | 4/1995 |
| EP | 1644683 | 4/2006 |
| WO | WO 2004/106835 | 12/2004 |

* cited by examiner

*Primary Examiner*—Allen J Flanigan
(74) *Attorney, Agent, or Firm*—Warn Partners, P.C.

(57) ABSTRACT

The present invention relates to a plate for a heat exchanger, which has beads of refrigerant distributing sections formed asymmetrically and streamlined beads arranged in the same number on flow channels in the form of a zigzag so that refrigerant flowing inside a tank is distributed and introduced to tubes uniformly, thereby increasing a heat radiation amount and enhancing a heat exchange efficiency by forming uniform flow distribution and reducing a pressure drop of refrigerant, and miniaturizing the heat exchanger into a compact size.

10 Claims, 9 Drawing Sheets
(2 of 9 Drawing Sheet(s) Filed in Color)

Prior Art

Prior Art

Prior Art

Prior Art

PLATE FOR HEAT EXCHANGER

BACKGROUND OF THE INVENTION

1. Field of the Invention

The present invention relates to a plate for a heat exchanger, and more particularly, to a plate for a heat exchanger, which has beads of refrigerant distributing sections formed asymmetrically and streamlined beads arranged in the same number on flow channels in the form of a zigzag so that refrigerant flowing inside a tank is distributed and introduced to tubes uniformly, thereby increasing a heat radiation amount and enhancing a heat exchange efficiency by forming uniform flow distribution and reducing a pressure drop of refrigerant, and miniaturizing the heat exchanger into a compact size.

2. Background Art

In general, a heat exchanger refers to a device in which a flow channel for heat exchange medium so that heat exchange medium exchanges heat with external air while being circulated through the flow channel. The heat exchanger is used in various air conditioning devices, and is employed in various forms such as a fin tube type, a serpentine type, a drawn cup type and a parallel flow type according to various conditions in which it is used.

The heat exchanger has an evaporator using refrigerant as heat exchange medium, which is divided into one-tank, two-tank and four-tank types:

In the one-tank type heat exchanger, tubes formed by coupling two one-tank plates each having a pair of cups formed at one end thereof and a U-shaped channel defined by a partitioning bead disposed therein are laminated alternately with heat radiation fins.

In the two-tank type heat exchanger, tubes formed by coupling two two-tank plates each having cups respectively formed at the top and bottom thereof are laminated alternately with heat radiation fins.

In the four-tank type heat exchanger, tubes formed by coupling two four-tank plates each having cup pairs formed at the top and bottom thereof and two channels divided by a separator are laminated alternately with heat radiation fins.

Hereinafter, for convenience, the one-tank type heat exchanger will be described as an example.

As shown in FIGS. 1 to 3, the heat exchanger 1 includes: a plurality of laminated tubes 10 formed by coupling two plates 11, each tube having a pair of cups 14 formed at the top or the top and bottom thereof side by side and respectively having slots 14*a* and a U-shaped channel 12 for fluidically communicating the tanks 40 defined by a partitioning bead 13 vertically formed between the tanks 40 to a predetermined length; heat radiation fins 50 laminated between the tubes 10; and two-end plates 30 mounted at the outermost sides of the tubes 10 and the radiation fins 50 to reinforce them.

In addition, both plates 11 facing to each other are embossed and so a plurality of inward-projected first beads 15 of the plates 11 are bonded, so that a turbulent flow of refrigerant is formed in the flow channel 12 of the tube 10.

Further, in the each tube 10, the flow channel 12 has refrigerant distributing sections 16 formed on inlet and outlet sides thereof, in which each refrigerant distributing section 16 has a plurality of passageways 16*b* partitioned by a plurality of second beads 16*a* so that refrigerant is uniformly distributed into the flow channel 12.

In addition, since the double head plate is substantially same as the single head plate 11 except that two cups are provided in the bottom end of the double head plate, hereinafter only the single head plate 11 having two cups 14 formed on the top end will be illustrated for the sake of convenience.

The tubes 10 also include manifold tubes 20 projecting to sides of the tanks 40, in which one of the manifold tubes 20 has an inlet manifold 21 connected with an inlet pipe 2 for introducing refrigerant and manifold tubes 20*a* projecting to the other sides of the tanks 40, in which one of the manifold tubes 20*a* has an outlet manifold 21*a* connected with an outlet pipe 3 for discharging refrigerant.

The manifolds 21 and 21*a* are constructed of a circular pipe type formed by contacting two manifold plates respectively having semi-circular manifolds 21 and 21*a*. The manifolds 21 and 21*a* are combined with the inlet pipe 2 and the outlet pipe 3 by a brazing material of a ring type, and then, the manifolds 21 and 21*a*, the inlet pipe 2 and the outlet pipe 3 are combined with one another by brazing.

Moreover, the manifold tubes 20 and 20*a* are the same as the tubes 10 except the manifolds 21 and 21*a*.

As described above, referring to FIG. 1, a flow of refrigerant inside the heat exchanger 1 will be described as follows.

The tanks 40 having the inlet manifold 21 and the outlet manifold 21*a* of the refrigerant further include baffles 60 formed therein for partitioning introduced refrigerant and discharge refrigerant from each other.

Therefore, based on the baffles 60, the tanks 40 are divided into an inlet side 4 for introducing refrigerant and an outlet side 5 for discharging refrigerant, the tank 40 of the inlet side 4 is designated as "A" and "B" parts and the tank 40 of the outlet side 5 for discharging refrigerant is designated as "C" and "D" parts in the drawing.

When being introduced through the inlet side manifold 21, refrigerant is uniformly distributed in the A part of the tank 40 and flows along the U-shaped flow channels 12 of the tubes 10 and 20. In succession, refrigerant is introduced into the B part of the adjacent tank 40, and then flows into the C part of the same tank 40. Refrigerant flows again along the U-shaped flow channels 12 of the tubes 10 and 20*a*, and then, is introduced into the D part of the tank 40 having the outlet manifold 21*a* to be finally discharged to the outside.

During the process that refrigerant circulating inside a cooling system along a refrigerant line is introduced and discharged, the heat exchanger 1 exchanges heat with the air blown between the tubes 10, 20 and 20*a* and evaporates refrigerant, whereby the air blown out to the inside of the automobile is cooled by a heat absorption action via evaporation latent heat of refrigerant.

Recently, with a compact and small-size oriented trend of the heat exchanger 1, the heat exchanger 1 has to be provided with structure and performance satisfying high efficiency and low refrigerant pressure drop. Particularly, in case of the refrigerant pressure drop, since the heat exchanger 1 is gradually narrowed, if the heat exchanger 1 is manufactured by plates of the existing form, it may cause increase in work of the compressor (not shown) and decrease of system efficiency due to high refrigerant pressure drop.

That is, the prior art heat exchanger includes the first beads 15 formed at regular intervals along the flow channels 12 and bonded with each other to enhance heating efficiency and secure durability of the heat exchanger 1, and the refrigerant distributing sections 16 having the second beads 16*a* formed at regular intervals to uniformly distribute refrigerant stored in the tank 40 to the flow channels 12 and securing durability.

However, like the prior art plate 11, if the first beads 15 and the second beads 16*a* formed on the refrigerant distributing sections 16 are formed at regular intervals symmetrically, as shown in FIG. 4, refrigerant may form ununiform flow distribution, and thereby, a heat radiation amount and a heat exchange efficiency are reduced, and so, it is difficult to miniaturize the heat exchanger into a compact size.

That is, in FIG. 4, a red color indicates a part where refrigerant of great flux flows fast, and a green color indicates a part where refrigerant of small flux flows slowly.

Therefore, when we see the whole flow of the plate, the plate 11 has another problem in that refrigerant flux is small at the center in a width (lateral) direction and high at both sides, and when we see the just flow of the refrigerant distributing section, there is a problem in that refrigerant of great flux flows at the center of the refrigerant distributing sections 16 but refrigerant of small flux flows ununiformly since the speed of refrigerant current is gradually slower toward both sides of the refrigerant distributing sections 16.

Furthermore, the plate 11 has another problem in that refrigerant of great flux flows and is crowded when refrigerant is more distant from the refrigerant distributing sections 16 in a longitudinal (vertical) direction of the plate 11.

As described above, the prior art plate 11 generally shows the ununiform refrigerant flow distribution in all directions.

SUMMARY OF THE INVENTION

Accordingly, the present invention has been made to solve the above-mentioned problems occurring in the prior arts, and it is an object of the present invention to provide a plate for a heat exchanger, which has second beads formed asymmetrically on refrigerant distributing sections of the plate with respect to the central line of a cup and streamlined first beads formed along the flow channels, arrays of the first beads of the same number being arranged in the form of a zigzag to distribute and introduce refrigerant of a tank to flow channels of tubes, thereby increasing a heat radiation amount and enhancing a heat exchange efficiency by forming uniform flow distribution and reducing a pressure drop of refrigerant, and miniaturizing the heat exchanger into a compact size.

To accomplish the above objects, according to the present invention, there is provided a plate for an heat exchanger comprising: cups formed at ends thereof so as to fluidically communicated with flow channels formed therein; a plurality of first beads protruding toward the flow channels to make a turbulent flow of refrigerant flowing inside the flow channels in such a manner that each array of the first beads is repeatedly arranged in the same number in the form of a zigzag; and refrigerant distributing sections formed at inlet and outlet sides of the flow channels, the refrigerant distributing sections having one or more second beads arranged asymmetrically with respect to the central line of the cup and a plurality of passageways partitioned by the second beads.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
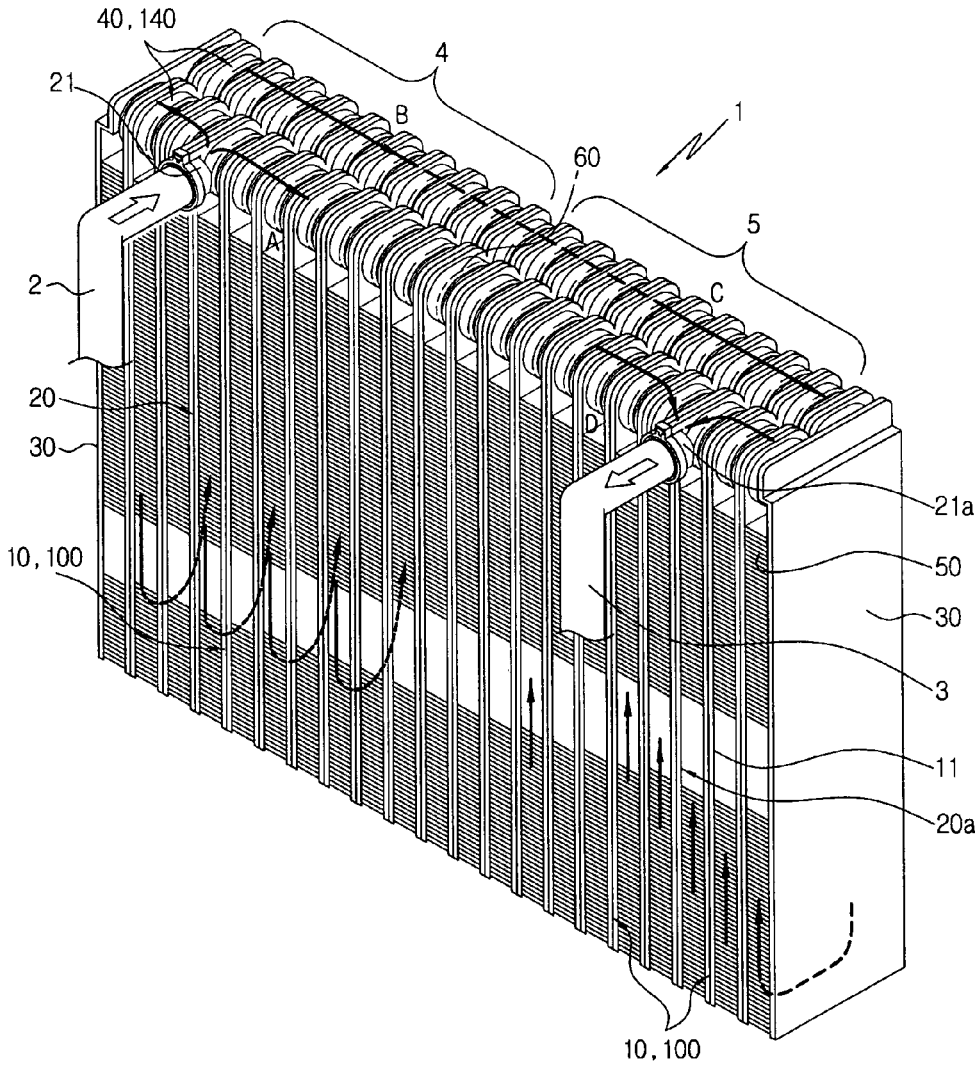
FIG. 1 is a perspective view of a prior art heat exchanger (evaporator)
Figure 2:
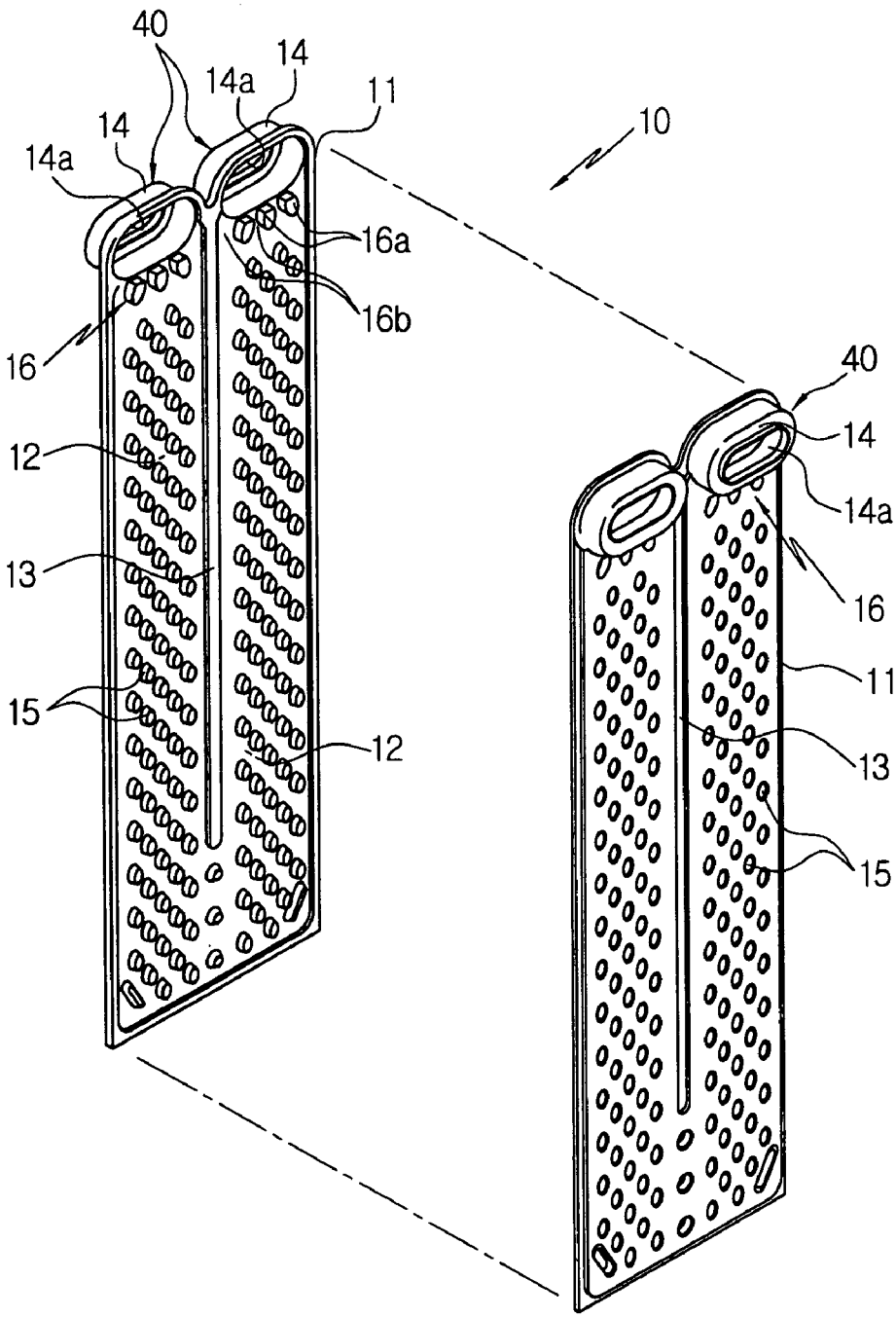
FIG. 2 is a perspective view showing a state that tubes are separated from the prior art heat exchanger.
Figure 3:
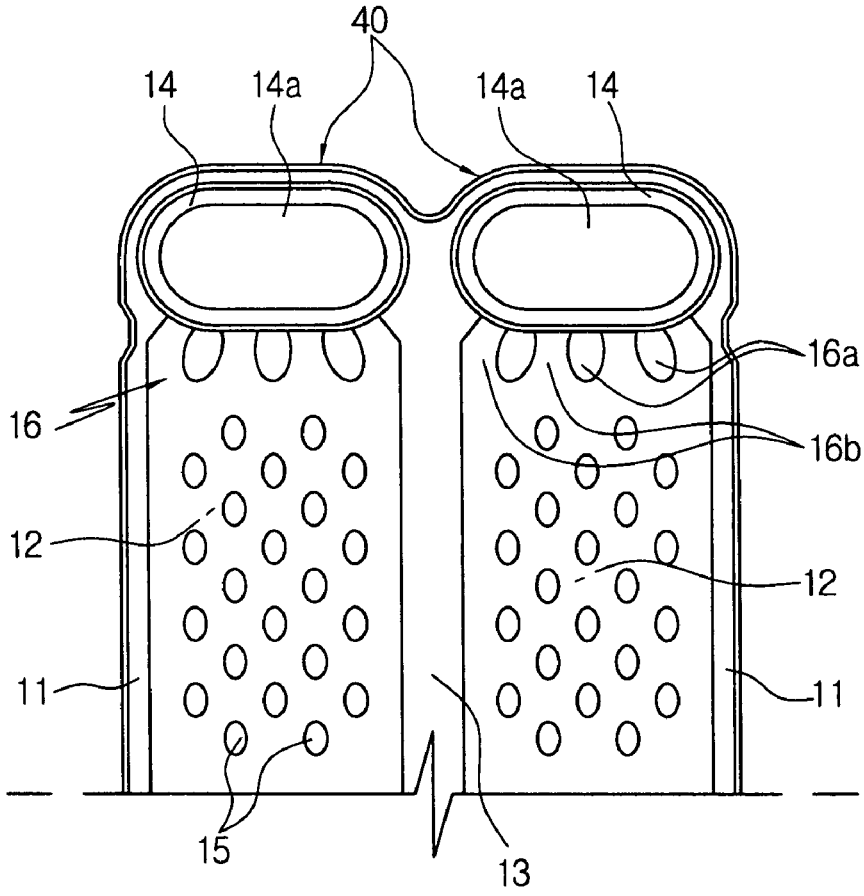
FIG. 3 is a view of the upper part of a plate of FIG. 2.
Figure 4:
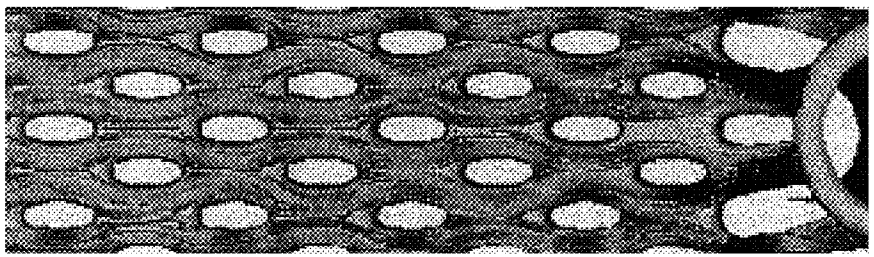
FIG. 4 is a color view showing a refrigerant flow distribution of the plate of FIG. 3.

Reference will be now made in detail to the preferred embodiment of the present invention with reference to the attached drawings.

The same reference numerals are used to designate the same or similar components as those of the prior art without repeated description thereof.

Figure 5:
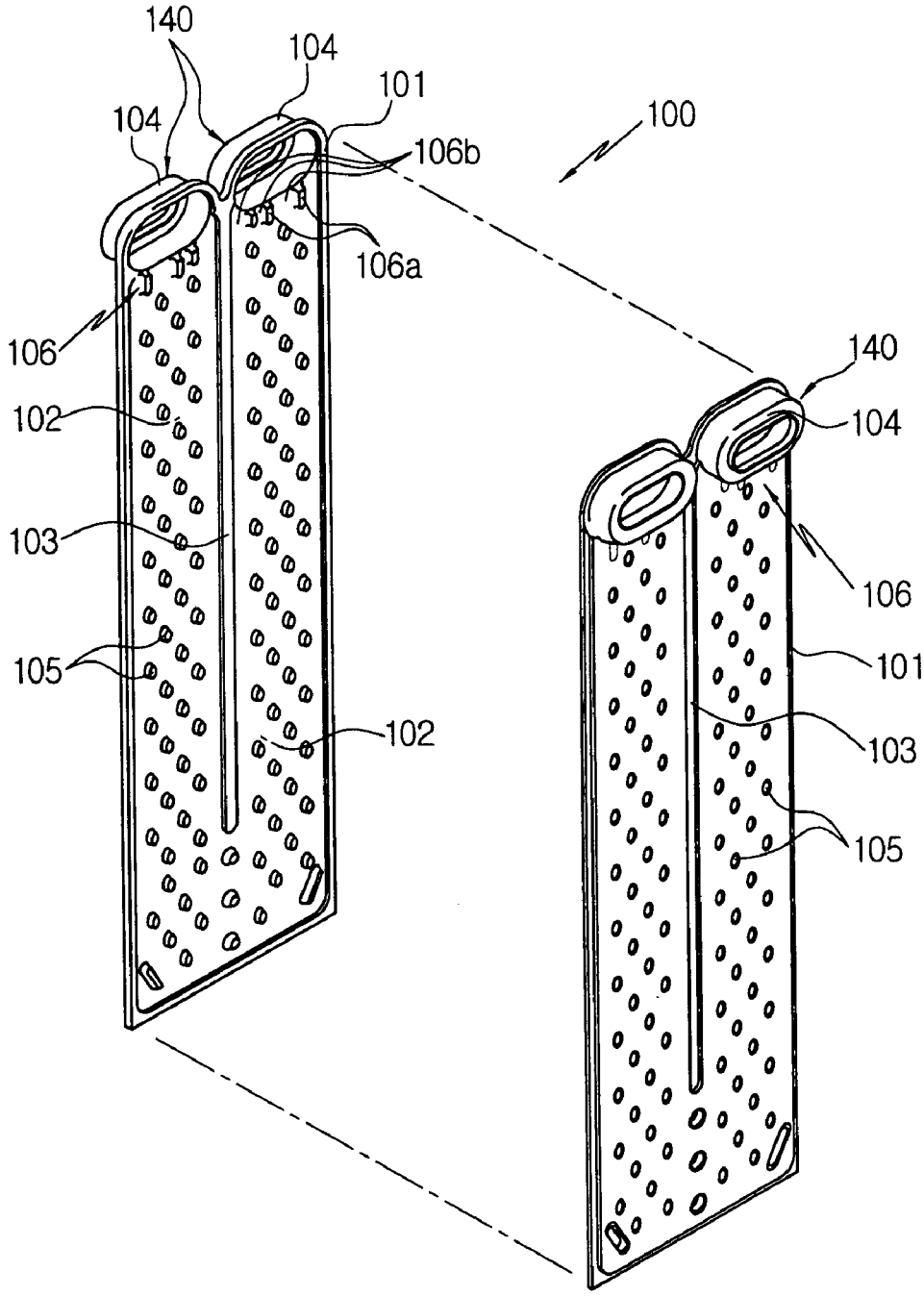
FIG. 5 is a perspective view showing a state where tubes are separated from a heat exchanger according to the present invention.
Figure 6:
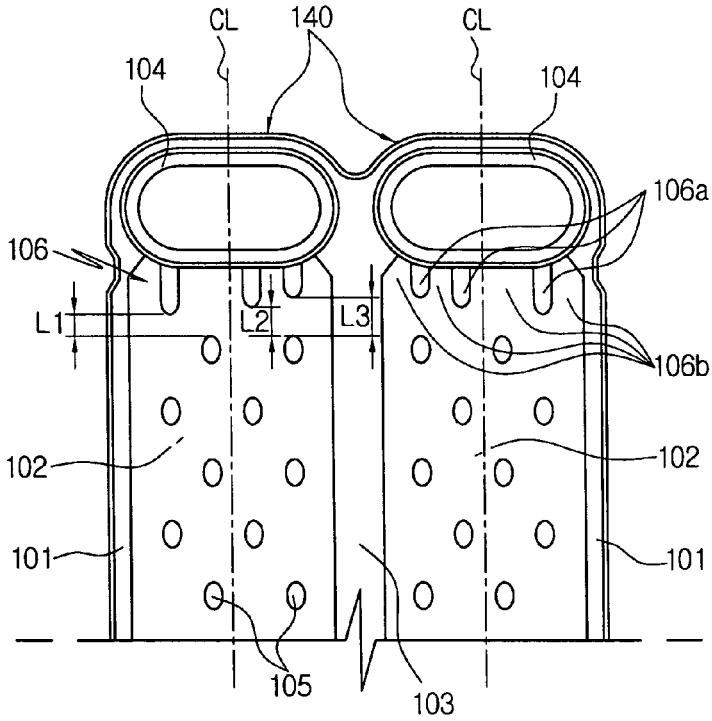
FIG. 6 is a view showing the upper part of a plate of FIG. 5.
Figure 7:
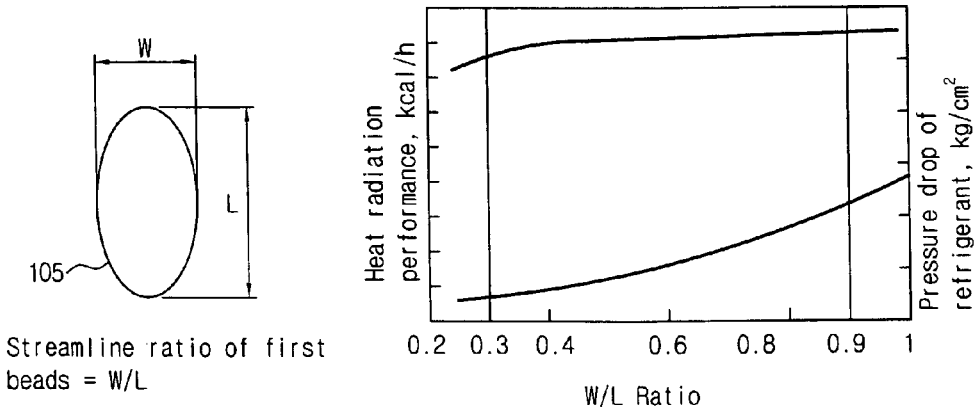
FIG. 7 is a graph showing a heat radiation performance and refrigerant pressure drop about the width to length ratio of a first bead according to the invention.
Figure 8:
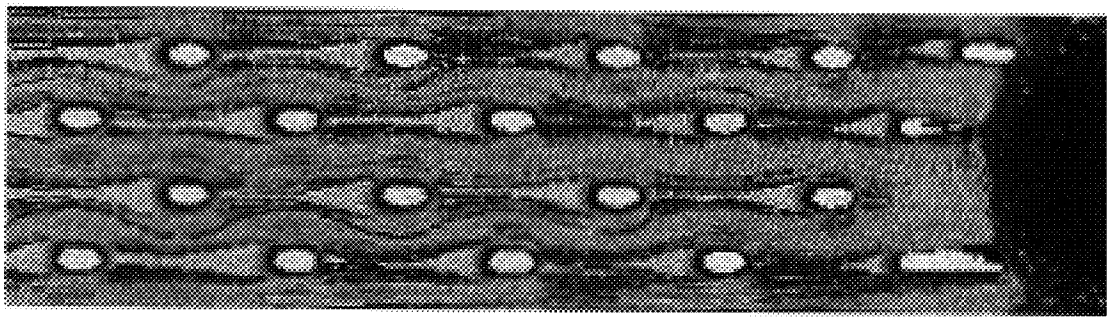
FIG. 8 is a color view showing a refrigerant flow distribution of the plate of FIG. 6.
Figure 9:
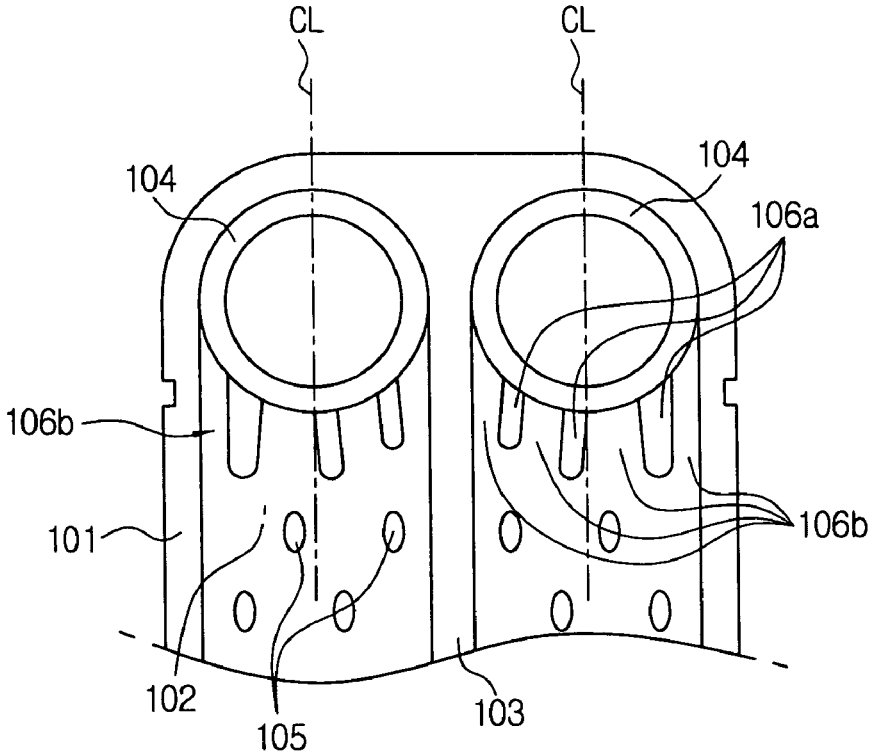
FIG. 9 is a view showing a state where second beads are formed inclinedly on inlet and outlet sides of a flow channel of the plate in the heat exchanger according to the present invention.
Figure 10:
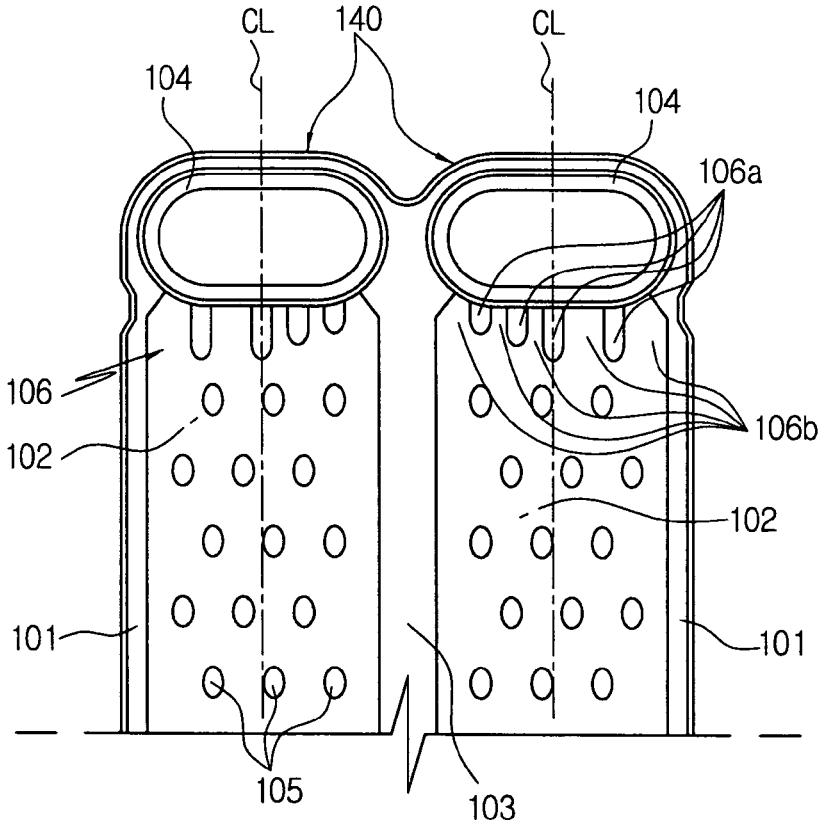
FIG. 10 is a view showing another form of the first and second beads formed on the plate in the heat exchanger according to the present invention.

FIG. 5 is a perspective view showing a state where tubes are separated from a heat exchanger according to the present invention, FIG. 6 is a view showing the upper part of a plate of FIG. 5, FIG. 7 is a graph showing a heat radiation performance and refrigerant pressure drop about the width to length ratio of a first bead according to the invention, FIG. 8 is a view showing a refrigerant flow distribution of the plate of FIG. 6, FIG. 9 is a view showing a state where second beads are formed inclinedly on inlet and outlet sides of a flow channel of the plate in the heat exchanger according to the present invention, and FIG. 10 is a view showing another form of the first and second beads formed on the plate in the heat exchanger according to the present invention.

While it is apparent that the present invention shall be applied equally to one-tank, two-tank and four-tank type heat exchangers, the following description will be made only in conjunction with the single tank type heat exchanger for the sake of convenience.

As shown in the drawings, the heat exchanger 1 according to the present invention includes: a plurality of tubes 100, each tube formed by bonding two plates 101 having a pair of parallel cups 104 formed at the top thereof, each tube having a pair of tanks 140 formed by bonding the cups 104 with each other and U-shaped flow channels 102 formed therein centering around a partition bead 103 vertically formed between the tanks 140 to a predetermined length to fluidically communicate the tanks 140 with each other;

heat radiation fins 50 interposed between the tubes 100 in a bent form for promoting a heat exchange performance by widening an electric heat area; and two end plates 30 mounted at the outermost sides of the tubes 100 and the heat radiation fins 50 to reinforce them.

In addition, the tubes 10 also include manifold tubes 20 projecting to sides of the tanks 40, in which one of the manifold tubes 20 has an inlet manifold 21 connected with an inlet pipe 2 for introducing refrigerant and manifold tubes 20*a* projecting to the other sides of the tanks 40, in which one of the manifold tubes 20*a* has an outlet manifold 21*a* connected with an outlet pipe 3 for discharging refrigerant.

Here, the manifold tubes 20 and 20*a* are the same as the tubes 10 except the inlet and outlet manifolds 21 and 21*a* protruding to the sides.

Moreover, the tank 140 having the inlet and outlet manifolds 21 and 21*a* has a baffle 60 formed therein for partitioning introduced refrigerant and discharged refrigerant from each other.

The laminated tubes 100 are divided into an inlet side 4 for introducing refrigerant and an outlet side 5 for discharging refrigerant by the baffle 60.

Therefore, refrigerant introduced into the inlet pipe 2 flows along the U-shaped flow channels 102 of the tubes 20 and 100 of the inlet side 4 divided by the baffle 60 and flows to the outlet side 5. After that, refrigerant flows along the U-shaped flow channels 102 of the tubes 20*a* and 100 of the outlet side 5, and then, discharged through the outlet pipe 3. Of course, refrigerant cools the external air through heat exchange with the external air during the process that refrigerant flows the tubes 100 of the inlet side 4 and the outlet side 5 in order.

The heat exchanger 1 has refrigerant distributing sections 106 formed at the inlet side and the outlet side of the flow channels 102 of the tubes 100 and having a plurality of passageways 106*b* partitioned by a plurality of second beads 106*a*.

Here, since the flow channel 102 is formed in a "U" shape by the partition bead 103 formed at the center of the plate 101, the inlet and outlet of the flow channel 102 are formed in parallel. Of course, in this instance, the above heat exchanger is the one-tank type heat exchanger, but, in the two-tank type or four-tank type heat exchanger, the inlet and outlet of the flow channel 102 are formed in the opposite directions.

In addition, the second beads 106*a* are formed and arrange asymmetrically with respect to the central line (CL) of the cup 104 to distribute and introduce refrigerant stored in the tank to the flow channels 102 uniformly.

That is, the second beads 106*a* are formed asymmetrically with respect to the central line (CL) of the cup 104 in the number, interval or shape.

FIG. 6 shows an example of the plate having the second beads formed asymmetrically. In FIG. 6, two of the second beads 106*a* are formed at the side of the partition bead 103 with respect to the central line (CL) of the cup 104, and one of the second beads 106*a* is formed outwardly. Additionally, in FIG. 6, the second beads 106*a* are formed asymmetrically in intervals among them and in shape.

Of course, in the drawing, the second beads 106*a* are formed asymmetrically in number, interval and shape, but the present invention is not restricted to the above, and can be formed asymmetrically in at least one of number, interval and shape.

Moreover, each of the second beads 106*a* is formed asymmetrically in an interval from the first array of the first beads 105. Here, it is preferable that at least one of the second beads 106*a* is formed asymmetrically, but it is preferable that an interval (L3) of the second bead 106*a* adjacent to the partition bead 103 from the first array of the first beads 105 is larger than an interval (L1) of the outermost second bead 106*a* from the first array of the first beads 105.

In addition, the sectional area of the passageway 106*b* formed at the side of the partition bead 103 with respect to the central line (CL) of the cup 104 is smaller than the sectional area of the passageway 106*b* formed at the other side, whereby refrigerant concentrated on the center is induced to the outside of the flow channel 102 when refrigerant inside the tank 140 is introduced into the flow channel 102. In this instance, the second bead 106*a* formed toward the larger passageway 106*b* is formed greater than other beads 106*a* to prevent that excessive refrigerant is crowded to the outside.

Furthermore, it is preferable that the refrigerant distributing sections 106 and the first beads 105 are formed symmetrically from the partition bead 103 for commonness of the plate 101 when the heat exchanger is manufactured.

That is, two plates 101 are faced and bonded to each other when the tube 100 is manufactured, and in this instance, the first and second beads 105 and 106*a* formed on the two plates 101 are bonded with each other to enhance pressure resistance of the heat exchanger. As described above, if the refrigerant distributing sections 106 and the first beads 105 are formed symmetrically from the partition bead 103, only one-type plates 101 can be manufactured in one press mold to be used for commonness with no need to manufacture two plates 101 separately for manufacturing the tube 100.

Meanwhile, the shape and size of the second beads 106*a* of the refrigerant distributing sections 106 are gradually increased toward the outside, and at least one second bead 106*a* and at least one first bead 105 are arranged on the same line.

Additionally, a plurality of the first beads 105 arranged by bonding sides of a pair of the plates 101 facing with each other are formed, so that a turbulent flow of refrigerant is formed in the flow channel 12 of the tube 100.

That is, the first beads 105 protrudes inwardly along the flow channels 102 of the plate 101 by an embossed-molding method, and are obliquely arranged in a lattice form to improve fluidity of refrigerant and induce the turbulent flow of refrigerant. The first beads 105 formed on the two plates 101 are bonded to each other by brazing in a state where they are in contact with each other.

In addition, arrays of the first beads 105 have the same number of the first beads 105 and arranged at regular intervals to make a flow distribution of refrigerant uniform, but it is preferable that the arrays of the first beads 105 are repeatedly arranged in zigzag.

In this instance, it is preferable that the first beads 105 formed at the uppermost end of the flow channels 102 are formed asymmetrically with respect to the central line (CL) of the cup 104.

Therefore, refrigerant can be distributed uniformly through combination of the asymmetric structure of the refrigerant distributing sections 106 and the asymmetric structure of the first beads 105 of the uppermost end. That is, refrigerant flowing inside the tank 140 can flow more uniformly into the flow channels 102.

Moreover, the first beads 105 are formed in a streamline form to reduce a pressure drop of refrigerant.

That is, the streamlined first beads 105 cause reduction of pressure drop of refrigerant, so that refrigerant can flow smoothly along the streamlined surfaces of the first beads 105 without occurring large pressure at stagnation points in a refrigerant inflow direction of the first beads 105.

Therefore, the first beads 105 according to the present invention are formed in streamline form to reduce pressure of the front ends thereof in the refrigerant inflow direction, remove non-uniformity in refrigerant flow distribution, and enhance the electrically heating performance, but are restricted in the ratio (W/L) of width (W) to length (L).

As shown in the graph of FIG. 7, when the width to length ratio (W/L) of the first beads 105 is small, the pressure drop of refrigerant is reduced but the heat radiation performance is decreased (about 2~3%).

However, when the width to length ratio (W/L) of the first beads 105 is large, the heat radiation performance is increased and the pressure drop of refrigerant is also increased, and thereby, the refrigerant flow distribution becomes ununiform.

Therefore, it is preferable that the width to length ratio (W/L) of the first beads 105 satisfies the following formula, $0.3 \leqq W/L \leqq 0.9$, which is a proper range.

FIG. 8 shows the refrigerant flow distribution according to the arrangement of the first beads 105 and the second beads 106*a*, and as shown in the drawing, the refrigerant flow distribution is generally more uniform than the refrigerant flow distribution that the first beads 15 and the second beads 16*a* of the prior art are arranged symmetrically at regular intervals with respect to the central line (CL) of the cup 104. That is, the plates 101 according to the present invention generally show the uniform flow since there is little deviation in speed in the width (lateral) direction and the longitudinal (vertical) direction of the flow channels 102.

FIG. 9 is a view showing a state where the second beads are formed inclinedly. As shown in the drawing, two second beads 106*a* formed at the side of the partition bead 103 with respect to the central line (CL) of the cup 104 is formed inclinedly toward the partition bead 103, but one second bead 106*a* formed at the other side is formed inclinedly in the outward direction.

Therefore, refrigerant crowded around the central portion of the refrigerant distributing sections 106 can be induced to both sides of the flow channels 102.

Meanwhile, FIG. 9 shows that a pair of the cups 104 are formed in a circle, but it would be appreciated that the cups 104 can be formed in one of other various shapes.

FIG. 10 shows another form of the first and second beads formed on the plate. As shown in the drawing, the number of the first beads 105 and the second beads 106*a* shown in FIG. 10 is increased more than that of the previous first and second beads, namely, the first beads 105 are formed in each array by three and the second beads 106*a* are formed in each array by four.

Also in this case, the second beads 106*a* of the refrigerant distributing sections 106 are formed asymmetrically with respect to the central line (CL) of the cup 104, and the first beads 105 are in the streamline form, and in this instance, the arrays having the first beads 105 of the same number are repeatedly arranged in zigzag.

As described above, without regard to the number of the first beads 105 and the second beads 106*a*, the second beads 106*a* of the refrigerant distributing sections 106 are formed asymmetrically with respect to the central line (CL) of the cup 104, the first beads 105 are in the streamline form, and the arrays having the first beads 105 of the same number are repeatedly arranged in zigzag, whereby the refrigerant flow distribution becomes uniform, the pressure drop of refrigerant is reduced so that a heat radiation amount is increased and the heat exchange efficiency is enhanced thereby to facilitate the miniaturization of the heat exchanger into a compact size.

As described above, the arrangement type of the first beads 105 and the second beads 106*a* is applied to the one-tank type heat exchanger 1, but the present invention is not restricted to the above, and the first beads 105 and the second beads 106*a* can be modified in various ways within the scope of claims of the present invention. In addition, the same structure can be also applied to the two-tank type or four-tank type heat exchanger to obtain the same effects as the present invention.

The plate for the heat exchanger includes the second beads formed asymmetrically on the refrigerant distributing sections of the plate with respect to the central line of the cup and the streamlined first beads formed along the flow channels, each array of the first beads being arranged in the same number in the form of a zigzag to distribute and introduce refrigerant of a tank to flow channels of tubes, thereby increasing the heat radiation amount and enhancing the heat exchange efficiency by forming the uniform flow distribution and reducing the pressure drop of refrigerant, and miniaturizing the heat exchanger into a compact size.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A plate for a heat exchanger comprising:

cups formed at ends thereof so as to fluidically communicated with flow channels formed therein;

a plurality of first beads protruding toward the flow channels in such a manner that each array of the first beads is repeatedly arranged in the same number in the form of a zigzag;

refrigerant distributing sections formed at inlet and outlet sides of the flow channels, the refrigerant distributing sections having one or more second beads arranged asymmetrically with respect to a vertical central line of the cup which is parallel with the longitudinal direction of the flow channel, and a plurality of passageways partitioned by the second beads; and wherein the inlet and outlet of the flow channel are formed in parallel by a partition bead formed at the center of the plate, and the sectional area of a passageway formed at the side of the partition bead with respect to the central line of the cup is smaller than the sectional area of a passageway formed in the opposite side, and the second beads formed at the side of the larger passageway are larger than other second beads.

2. The plate for the heat exchanger according to claim 1, wherein the number of the second beads is asymmetric.

3. The plate for the heat exchanger according to claim 1, wherein the second beads are asymmetric in interval between the second beads.

4. The plate for the heat exchanger according to claim 1, wherein the second beads are asymmetric in shape.

5. The plate for the heat exchanger according to claim 1, wherein each of the second beads is irregular in interval from the first array of the first beads.

6. The plate for the heat exchanger according to claim 1, wherein the first beads are in the form of a streamline, and a ratio (W/L) of width (W) to length (L) satisfies the following formula, $$0.3 \leqq W/L \leqq 0.9.$$

7. The plate for the heat exchanger according to claim 1, wherein the inlet and outlet of the flow channel are formed in parallel by a partition bead formed at the center of the plate, and the second beads formed at the side of the partition bead with respect to the central line of the cup are inclined toward the partition bead but the second bead formed at the other side is inclined outwardly.

8. The plate for the heat exchanger according to claim 1, wherein the inlet and outlet of the flow channel are formed in parallel by a partition bead formed at the center of the plate, the refrigerant distributing sections and the first beads are formed symmetrically with respect to the partition bead.

9. The plate for the heat exchanger according to claim 1, wherein the first beads formed at the uppermost end of the flow channel are formed asymmetrically with respect to the central line of the cup.

10. The plate for the heat exchanger according to claim 5, wherein when the inlet and outlet of the flow channel are formed in parallel by a partition bead formed at the center of the plate, an interval of the second bead adjacent to the partition bead from the first array of the first beads is larger than an interval of the outermost second bead.

* * * * *